US007263311B2

(12) United States Patent
Ikeda

(10) Patent No.: US 7,263,311 B2
(45) Date of Patent: Aug. 28, 2007

(54) PRESSURE RELEASING DEVICE AND IMAGE FORMING DEVICE

(75) Inventor: Wataru Ikeda, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 155 days.

(21) Appl. No.: 11/178,471

(22) Filed: Jul. 12, 2005

(65) Prior Publication Data

US 2006/0013614 A1 Jan. 19, 2006

(30) Foreign Application Priority Data

Jul. 15, 2004 (JP) ..... 2004-208982

(51) Int. Cl.
*G03G 15/16* (2006.01)
*G03G 21/00* (2006.01)
*G03G 15/20* (2006.01)

(52) U.S. Cl. ..... 399/122; 399/124; 399/328

(58) Field of Classification Search ..... 399/68, 399/107, 122, 124, 322, 323, 328, 125, 405
See application file for complete search history.

(56) References Cited

U.S. PATENT DOCUMENTS 6,643,483 B1 * 11/2003 Hirabayashi ..... 399/124
6,678,490 B2 * 1/2004 Tanaka ..... 399/124
6,871,032 B2 * 3/2005 Iida ..... 399/124

FOREIGN PATENT DOCUMENTS

JP 2002-311743 A 10/2002

* cited by examiner

*Primary Examiner*—Hoang Ngo
(74) *Attorney, Agent, or Firm*—Foley & Lardner LLP

(57) ABSTRACT

A pressure releasing member, which rotates a pressure roller pressing member which presses a pressure roller in the direction toward a heat roller in a pressure releasing direction, is configured to rotate in connection with a paper discharge unit cover. When the pressure releasing member rotates, the pressure roller is released from the pressure from the pressure roller pressing member.

8 Claims, 5 Drawing Sheets

PRESSURE RELEASING DEVICE AND IMAGE FORMING DEVICE

CROSS-REFERENCE TO RELATED APPLICATIONS

This application is based upon and claims the benefit of priority from prior Japanese Patent Application No. 2004-208982, filed Jul. 15, 2004, the entire contents of which are incorporated herein by reference.

BACKGROUND OF THE INVENTION

1. Field of the Invention

The present invention relates to a pressure releasing mechanism of a fixing device required for processing a paper feeding error (paper jam) in an image forming device such as a copying machine, a printer or the like, and an image forming device using the pressure releasing mechanism.

2. Description of the Related Art

In an image forming device such as a copying machine, a printer or the like where an image is formed on a paper sheet, a path to feed paper sheets (paper path) is arranged inside of the device, and by a paper feed roller in this paper path, paper sheets are fed to an image forming unit that forms a toner image on paper sheets, and a fixing unit that heats the toner image formed on paper sheets and pressurizes and fixes it onto paper sheets, and then paper sheets are discharged to the outside of the device. However, paper sheets may not be in ideal conditions for the device in many cases, and owing to changes in paper sheet conditions such as high humidity, curling, and the like, and conditions of the paper feed roller and the paper path, an error (jam) accidentally occurs where papers stop in the paper path.

At occurrence of this jam, it is necessary for a user to remove jammed paper sheets from the paper path, and especially in a fixing device, because paper sheets go through between a heat roller and a pressure roller to which a predetermined pressure is added, if a jam occurs while paper sheets go between them, it is required to release the pressure that is added between the rollers.

As this pressure releasing means, there is disclosed an art to release pressure by pressing/releasing a frame supporting a heat roller by a cam, and easily remove paper sheets (for example, Jpn. Pat. Appln. KOKAI Publication No. 2002-311743).

However, in such a pressure releasing method by rotating a cam as disclosed in the above Jpn. Pat. Appln. KOKAI Publication No. 2002-311743, it is necessary to rotate the cam electrically by a device, or manually by a user. In the former case, a motor for rotating the cam for processing a jam error is required, which increases costs. Further, in the latter case, it is required for a user to carry out a troublesome operation. In this jam processing, there are many operation procedures including opening a cover, rotating a cam, and so forth, and an inexperienced user frequently makes mistakes in the procedures, as a result, paper sheets cannot be removed easily, and further, there is a fear a user may try removing paper sheets forcibly without knowing correct procedures, and destroy the device.

BRIEF SUMMARY OF THE INVENTION

According to an aspect of the present invention there is provided a pressure releasing device comprising:

a first member;

a second member arranged at the position to face the first member;

a pressure member which rotates about a first rotating shaft, and presses the second member in the direction toward the first member by elastic force of an elastic member;

a pressure releasing member which rotates about a second rotating shaft arranged at one end thereof, and has a protrusion to rotate the pressure releasing member in a pressure releasing direction; and a cover member which is arranged to rotate about a third rotating shaft, and press the other end of the pressure releasing member, and thereby make the pressure releasing member rotate about the second rotating shaft, and press the pressure member in the pressure releasing direction by the protrusion.

According to an aspect of the present invention there is provided an image forming device comprising:

a heat roller;

a pressure roller arranged at the position to face the heat roller;

a pressure member which rotates about a first rotating shaft, and presses the pressure roller in the direction toward the heat roller by elastic force of an elastic member;

a pressure releasing member which rotates about a second rotating shaft arranged at one end thereof, and has a protrusion to rotate the pressure member in a pressure releasing direction; and a cover member which is arranged to rotate about a third rotating shaft, and press the other end of the pressure releasing member, and thereby make the pressure releasing member rotate about the second rotating shaft, and press the pressure member in the pressure releasing direction by the protrusion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

In the present invention, a pressure releasing member is arranged that rotates a pressure member that gives pressure from a pressure roller of a fixing device to a heat roller, by use of the weight of a paper discharge unit cover, in the direction to release the pressure. By adoption of this pressure releasing mechanism, the pressure on the fixing device may be easily released, and jam processing may be carried out easily.

Figure 1:
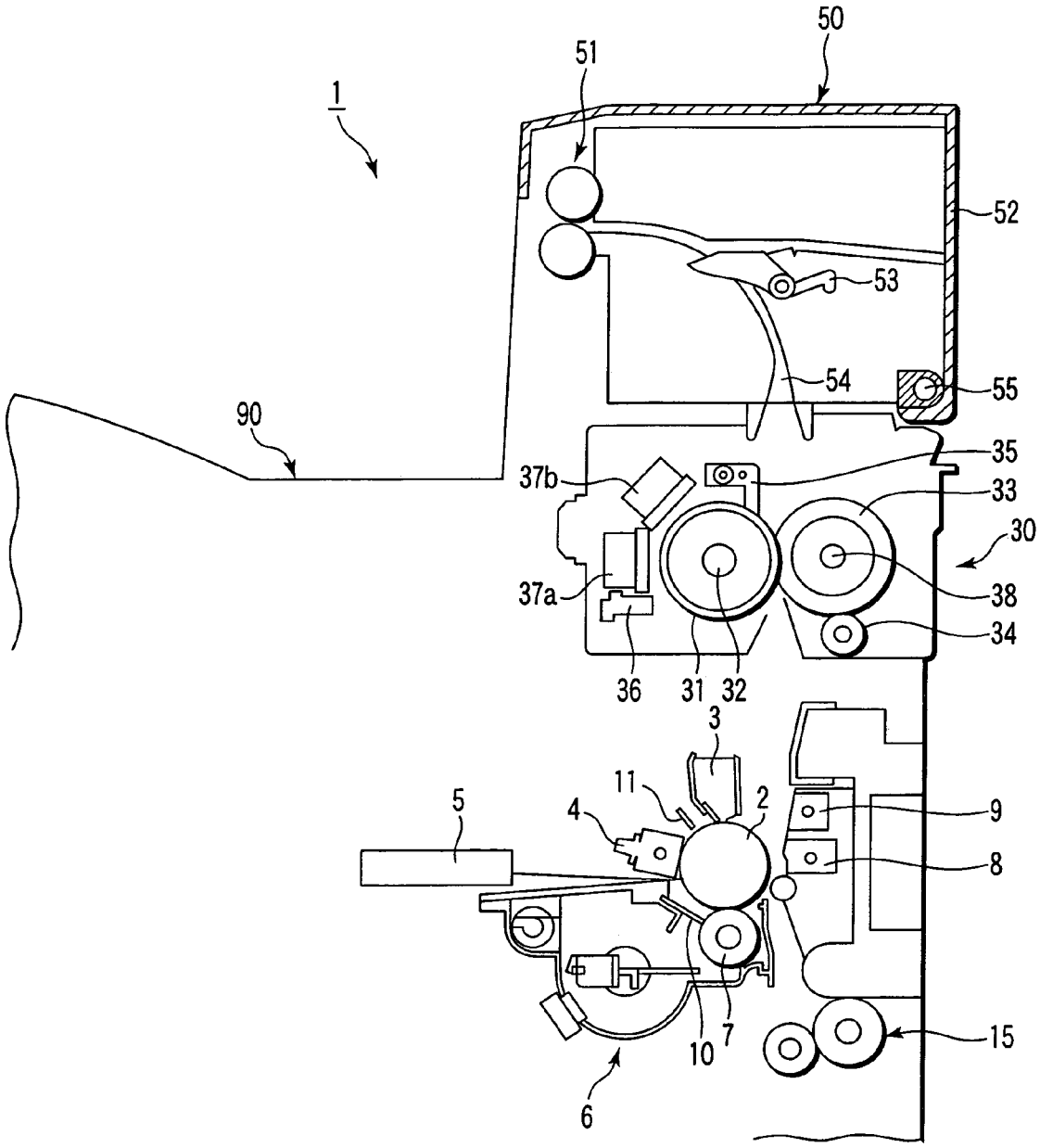
FIG. 1 is a schematic cross sectional view showing an image forming device according to one embodiment of the invention.

Embodiments according to the invention are illustrated by reference to FIGS. 1 to 5 hereinafter. FIG. 1 is a schematic cross sectional view showing an image forming device 1 to which the invention is applied. This image forming device 1 comprises a paper feed unit (not shown), an image forming unit, a fixing unit, and a paper discharging unit.

In the image forming unit, components necessary for image formation are arranged around a photosensitive drum 2, in the order of a cleaning device 3, a destaticizer 11, a electrifire 4, an exposure device 5, a developing roller 7 that supplies toner from a developing device 6, a transfer charger 8, and a releasing charger 9.

Hereinafter, actions of the image forming unit are explained. Toner and the like left on the surface of the photosensitive drum 2 are removed by the cleaning device 3, and residual electric charge on the surface is removed by the destaticizer 11. Then, by the electrifire 4, minus electric charge is given evenly onto the surface of the photosensitive drum 2, and by the exposure device 5, an electrostatic latent image is formed. In the developing device 6, an developing agent consisting of carrier and toner is contained, and the layer thickness of the developing agent on the surface of the developing roller 7 is regulated by a doctor blade 10, and the electrostatic latent image is made into an explicit image by toner. A paper sheet transferred from a paper feed device (not shown) is transferred to between the photosensitive drum 2 and the copy charger 8 at a timing controlled by a pair of resist rollers 15, and this explicit toner image is transferred onto the paper sheet. The paper sheet onto which the toner image is transferred attaches to the photosensitive drum 2, therefore, it is peeled off the photosensitive drum 2 by the releasing charger.

Next, a fixing device 30 is explained. The fixing device melts and fixes the toner image onto the paper sheet surface, by heat and pressure. The fixing device 30 has its main components of a heat roller 31, a lamp 32 as a heat source arranged in the heat roller 31, and a pressure roller 33 that contacts the heat roller 31 with a predetermined pressure. Around the heat roller 31, a thermistor 36 that performs temperature detection for controlling the surface temperature of the heat roller 31 at a predetermined temperature (for example, 180° C.), thermostats 37*a* and 37*b* that detect that the surface temperature of the heat roller 31 becomes an abnormal value owing to an error in the thermistor 36, and stop the power supply to the lamp 32, and a releasing pawl 35 that peels off the paper sheet that goes through a nip portion where heat and pressure are given onto the paper sheet between the heat roller 31 and the pressure roller 33 and attaches to the surface of the heat roller 31, are arranged. The pressure roller 33 has a pressure roller rotating shaft 38, and follows in conjunction with the driving of the heat roller. Further, a cleaning roller 34 that removes work-up of melt toner or the like on the surface of the pressure roller 33 is arranged.

A paper discharge unit 50 discharges paper sheets onto which a toner image is fixed by the fixing device 30 to the outside of the device. Paper sheets that pass the fixing device 30, go through a paper discharge path 54, and are discharged to a paper discharge tray 90 at the outside of the device by a pair of paper discharge rollers 51. The external surface of this paper discharge unit 50 is covered with a paper discharge unit cover 52, and this paper discharge unit cover 52 is configured releasably with a cover rotating shaft 55 as its fulcrum. The paper discharge unit cover 52 is configured to open and enable to expose the paper path for removing paper sheets, in the case of occurrence of a jam error in the fixing device 30 and/or the paper discharge unit 50.

Note that the right side of the image forming device 1 is configured such that paper reversing device (not shown) for forming images on both the surfaces of a paper sheet may be attached thereto. When this paper reversing device is attached, the pair of paper discharge rollers 51 may rotate in the reverse direction to the paper discharging direction, and by switching the paper path by the paper discharge guide 53, once discharged paper sheets may be fed to the paper reversing device.

Figure 2:
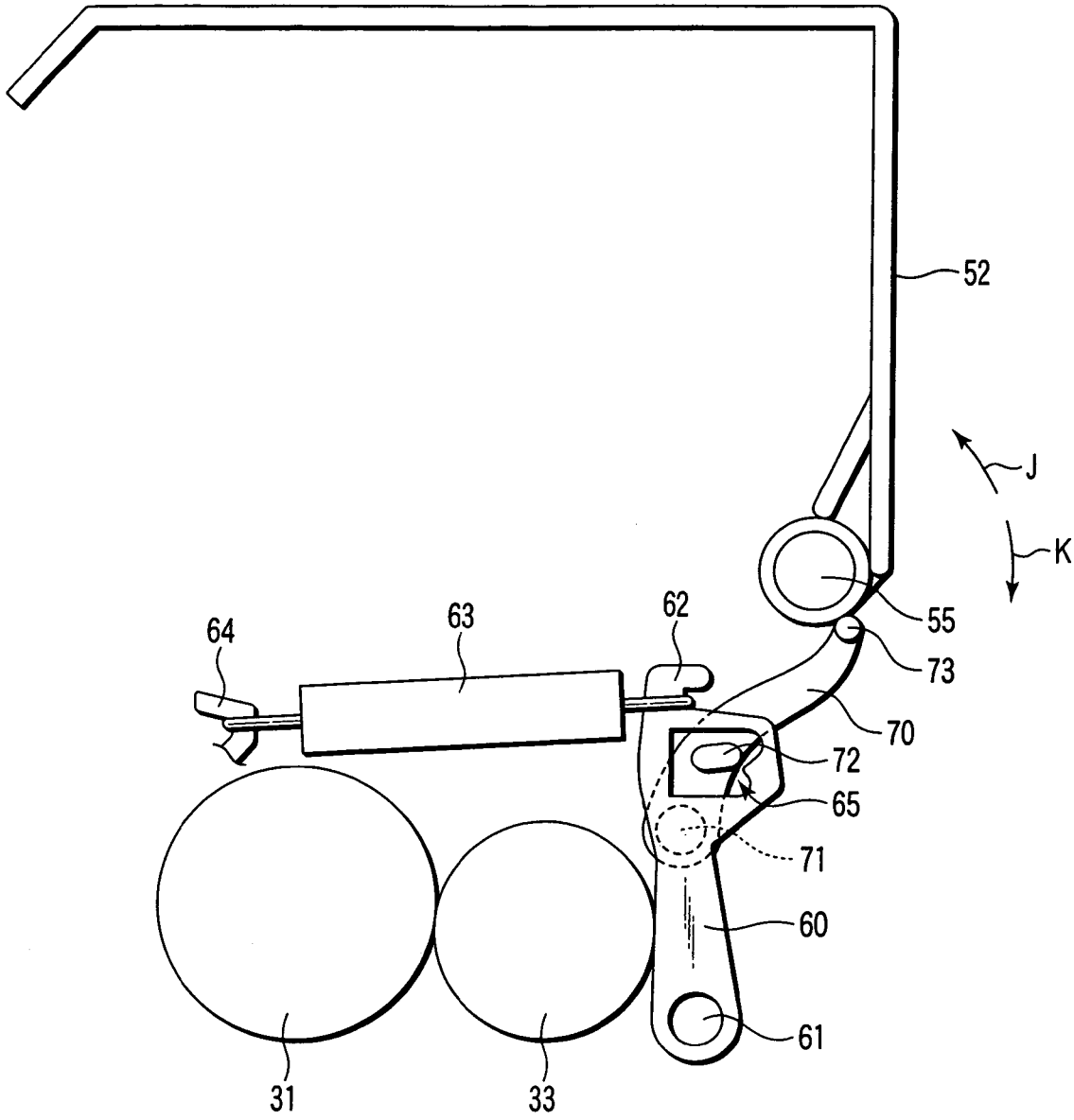
FIG. 2 is a cross sectional view showing a pressure releasing mechanism according to one embodiment of the invention.

Next, the mechanism to release the pressure of the pressure roller 33 to the heat roller 31 in the fixing device 30 according to the invention is described hereinafter. FIG. 2 is a schematic cross sectional view showing a pressure releasing mechanism according to the invention. A pressure roller pressing member 60 has a rotating shaft 61 at one end thereof, and is configured rotatably about the rotating shaft, and at the other end thereof, it has a hook unit 62 to hook a spring 63 for pulling the pressure roller pressing member 60 toward the pressure roller 33. The other end of this spring 63 is hooked to a hook 64 at the side of the main body or the fixing device 30, as a result, the side surface of the pressure roller pressing member 60 presses the end of the pressure roller 33 toward the heat roller 31 with a predetermined pressure. Although not illustrated, this pressure roller pressing member 60 is arranged at both the ends of the pressure roller 33, and puts load onto both the ends of the pressure roller 33, and thereby presses the pressure roller 33 toward the heat roller 31.

A pressure releasing member 70 has a rotating shaft 71 at one end thereof, and is configured rotatably about this rotating shaft.

The other end 73 of this pressure releasing member 70 is arranged so as to contact the above explained paper discharge unit cover. In the intermediate of this pressure releasing member 70, a protrusion 72 is arranged so as to get into a window unit 65 formed in the intermediate of the pressure roller pressing member 60.

Figure 3:
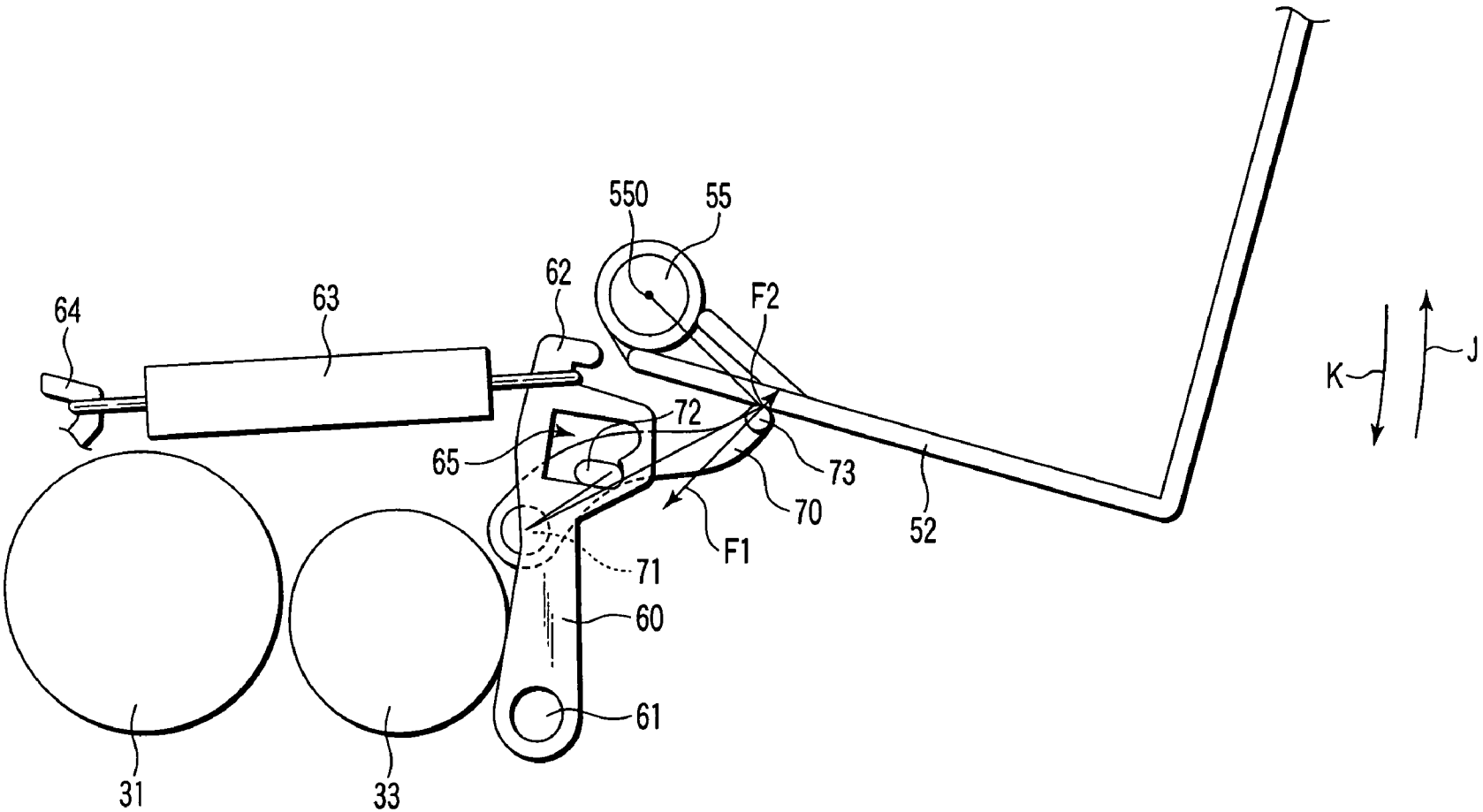
FIG. 3 is a cross sectional view showing the status at pressure release in a pressure releasing mechanism.

FIG. 3 is a cross sectional view showing the status when the pressure of the pressure roller to the heat roller is released. When the paper discharge unit cover 52 is opened in its opening direction K, by the weight of the paper discharge unit cover 52, the end 73 of the pressure releasing member 70 rotates around the rotating shaft 61 so as to go along the external side of the paper discharge unit cover 73. By this rotation, the protrusion 72 of the pressure releasing member 70 in the window unit 65 presses the side surface of the window unit 65 in the direction to expand the spring 63. This protrusion 72 presses the window unit 65, thereby, the force with which the side surface of the pressure roller pressing member 60 presses the pressure roller 33 is released.

At the point where the protrusion 72 contacts the window unit 65, force in the direction in which the spring 63 contracts (pressing direction), and force that the end 73 receives from the paper discharge unit cover 52 in the direction contradicting thereto work. At the point where both the forces are evenly balanced, the pressure roller pressing member 60 stops its rotation. In the embodiment, the own weight F1 of the paper discharge unit cover 52 is 5N, and the reaction force F2 by the spring 63 is 1N. In this manner, the own weight F1 of the paper discharge unit cover 52 is larger than the reaction force F2 by the spring 63.

Note that, as shown in FIG. 3, the arrow J in the counterclockwise direction around the center 550 of the rotating shaft (third rotating shaft) of the paper discharge unit cover 52 is defined as the closing direction of the paper discharge unit cover 52, and the arrow K in the clockwise direction around the center 550 is defined as the opening direction of the paper discharge unit cover 52.

Figure 4:
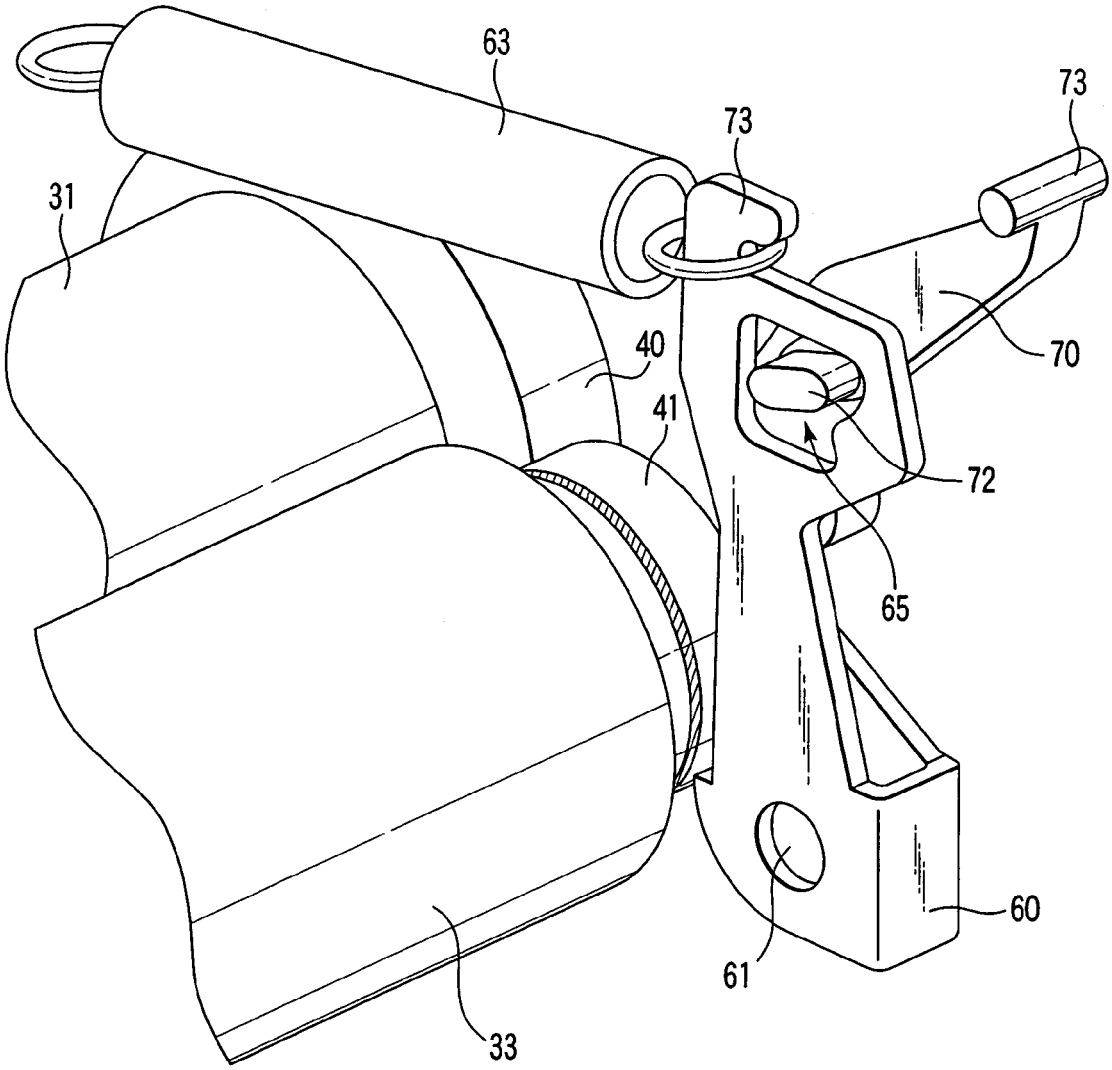
FIG. 4 is a perspective view showing a pressure releasing mechanism.

FIG. 4 is a perspective view showing the above mentioned pressure releasing mechanism. As shown in FIG. 4, to the side portion of the pressure roller pressing member 60, force is given by the spring 63 in the direction to press an end 41 whose diameter is smaller than that of the pressure roller 33. This pressure roller end 41 contacts a heat roller end 40 having a larger diameter than that of the heat roller 31. Thereby, the load by the spring 63 is controlled so as not to become over a predetermined value.

Figure 5:
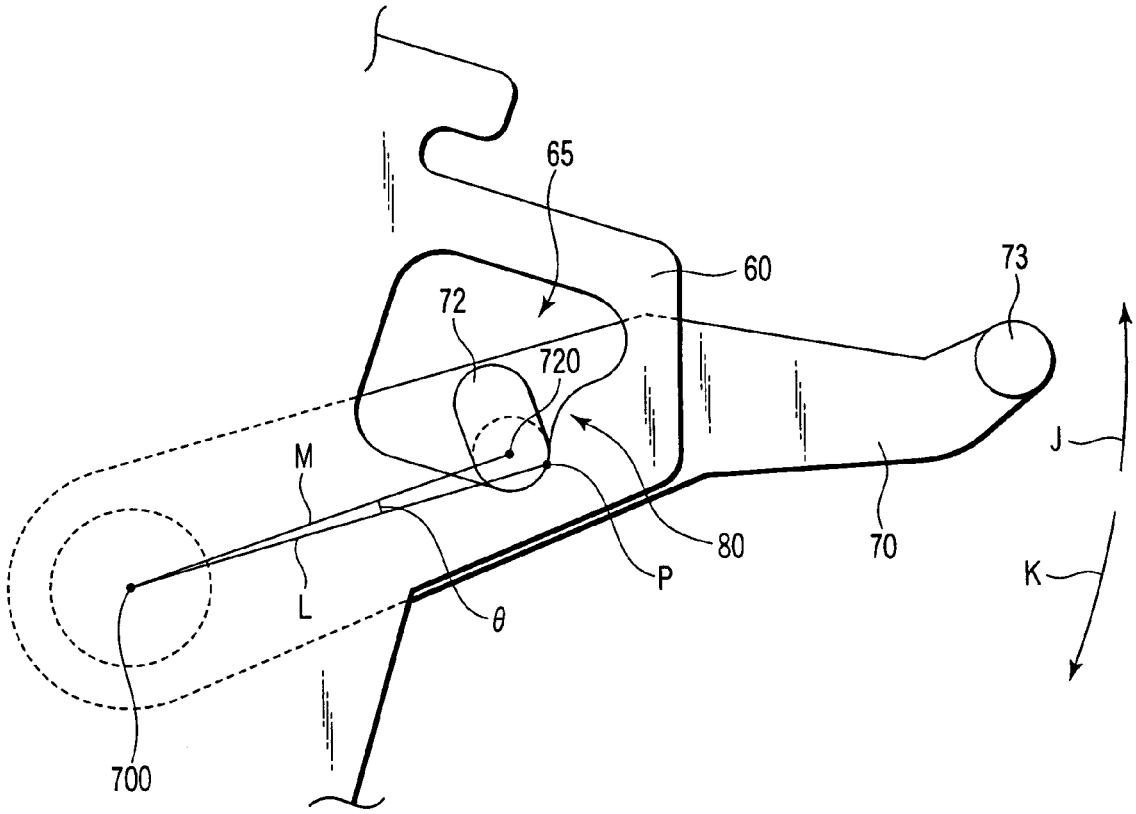
FIG. 5 is a view showing a window unit shape.

FIG. 5 is a figure showing the positions of the window unit 65 and the protrusion 72 at pressure release. The window unit 65 is shaped to have a notch to fit the shape of the protrusion 72, and a locking unit 80 to prevent movement of the protrusion 72 at pressure release. The portion of the protrusion 72 that contacts the window unit 65 has at least a curvature, and the end thereof may be made circular as shown in the figure.

In the line from the notch to the locking unit 80 of the window unit 65, the protrusion 72 stops at pressure release, but in this line, there is a point P where the protrusion 72 becomes away from the window unit 65. In other words, the point P is the point where the contact between the protrusion 72 and the window unit 65 is cut off, while the protrusion 72 and the window unit 65 are engaged with each other. The straight line L connecting this point P and the center 700 of the rotating shaft (first rotating shaft) of the pressure releasing member 70 must be positioned more in the releasing direction K of the paper discharge unit cover 52 than the straight line M connecting the curvature center 720 of the curvature of the protrusion 72 and the center 700 of the rotating shaft of the pressure releasing member 70.

The straight line L and the straight line M have a predetermined angle θ. In the embodiment, the angle θ is 4.8 degrees. Since the protrusion 72 is fixed to the pressure releasing member 70, the straight line L hardly changes its position, therefore, it is possible to increase the angle θ by making larger the own weight of the paper discharge unit cover 52, and to decrease the angle θ by making smaller the own weight of the paper discharge unit cover 52.

For example, when the straight line L is positioned more in the closing direction J than the straight line M, even if there becomes no load of the paper discharge unit cover 52 to the pressure releasing member 70, the protrusion 72 cannot be moved. This angle θ is determined by the distance from the rotating shaft 71 of the pressure releasing member to the protrusion 72, the pressure, and the weight of the paper discharge unit cover 52.

As explained above, by providing the pressure releasing mechanism that works in connection with the external cover of the device, it is possible to release the pressure of the pressure roller to the heat roller, only by opening the paper discharge unit cover, and it is possible for a user to easily conduct a jam error process, and to improve user's operationality.

Note that the invention is not limited to the above embodiments, but the invention may be embodied in other specific forms without departing from the spirit or essential characteristics thereof. For example, the notch and the locking unit are not limited to the embodiment where they are formed on the side surface of the window unit, but may be formed on the side surface of the pressure roller pressing member.

What is claimed is:

1. A pressure releasing device comprising:

a first member;

a second member arranged at the position to face the first member;

a pressure member which rotates about a first rotating shaft, and presses the second member in the direction toward the first member by elastic force of an elastic member;

a pressure releasing member which rotates about a second rotating shaft arranged at one end thereof, and has a protrusion to rotate the pressure releasing member in a pressure releasing direction; and a cover member which is arranged to rotate about a third rotating shaft, and press the other end of the pressure releasing member, and thereby make the pressure releasing member rotate about the second rotating shaft, and press the pressure member in the pressure releasing direction by the protrusion.

2. The pressure releasing device according to claim 1, wherein in the pressure release actions, the cover member stops at a point where the own weight of the cover member which works onto the pressure releasing member and the elastic force of the elastic member are evenly balanced.

3. A pressure releasing device according to claim 2, wherein the pressure member has a notch to fit the shape of the protrusion at the position to contact the protrusion.

4. The pressure releasing device according to claim 3, wherein the protrusion is configured to have a curvature at least at a part of the side surface thereof, and the shape of the notch is formed such that, at its engagement with the protrusion, the straight line connecting the point where the contact with the protrusion is maintained and the curvature center of the curvature, and the straight line connecting the center of the second rotating shaft and the curvature center has a predetermined angle.

5. An image forming device comprising:

a heat roller;

a pressure roller arranged at the position to face the heat roller;

a pressure member which rotates about a first rotating shaft, and presses the pressure roller in the direction toward the heat roller by elastic force of an elastic member;

a pressure releasing member which rotates about a second rotating shaft arranged at one end thereof, and has a protrusion to rotate the pressure member in a pressure releasing direction; and a cover member which is arranged to rotate about a third rotating shaft, and press the other end of the pressure releasing member, and thereby make the pressure releasing member rotate about the second rotating shaft, and press the pressure member in the pressure releasing direction by the protrusion.

6. The image forming device according to claim 5, wherein in the pressure release actions, the cover member stops at a point where the own weight of the cover member which works onto the pressure releasing member and the elastic force of the elastic member are evenly balanced.

7. The image forming device according to claim 6, wherein the pressure member has a notch to fit the shape of the protrusion at the position to contact the protrusion.

8. The image forming device according to claim 7, wherein the protrusion is configured to have a curvature at least at a part of the side surface thereof, and the shape of the notch is formed such that, at its engagement with the protrusion, the straight line connecting the point where the contact with the protrusion is maintained and the curvature center of the curvature, and the straight line connecting the center of the second rotating shaft and the curvature center has a predetermined angle.

* * * * *